United States Patent [19]

Crouch

[11] Patent Number: 4,858,775

[45] Date of Patent: Aug. 22, 1989

[54] PERSONNEL TROLLEY AND ELEVATOR PLATFORM FOR A CARGO CONTAINER HANDLING GANTRY CRANE

[75] Inventor: John H. Crouch, Long Beach, Miss.

[73] Assignee: Paceco Corp., San Mateo, Calif.

[21] Appl. No.: 156,304

[22] Filed: Feb. 12, 1988

[51] Int. Cl.[4] ..... B66C 19/00

[52] U.S. Cl. ..... 212/205; 212/206; 212/210; 212/219; 414/139.5; 414/141.3

[58] Field of Search ..... 414/137, 139, 139.5, 414/140.3, 141.3; 212/206, 210, 218, 219, 220, 217; 182/142

[56] References Cited

U.S. PATENT DOCUMENTS

| | | | |
|---|---|---|---|
| 3,051,322 | 8/1962 | Bellinger | 414/141.3 |
| 3,389,809 | 6/1968 | Wilson | 212/206 |
| 3,696,947 | 10/1972 | Ponsen | 212/206 |
| 3,881,608 | 5/1975 | Hupkes | 414/139 |
| 3,945,503 | 3/1976 | Cooper | 212/219 |
| 4,049,132 | 9/1977 | Stromback | 414/141.3 |
| 4,546,852 | 10/1985 | Martin et al. | 182/142 |
| 4,676,339 | 6/1987 | Rybka et al. | 182/142 |
| 4,705,140 | 11/1987 | Dudley et al. | 182/3 |

FOREIGN PATENT DOCUMENTS

| | | | |
|---|---|---|---|
| 895905 | 1/1982 | U.S.S.R. | 212/218 |

*Primary Examiner*—Sherman D. Basinger
*Assistant Examiner*—Thomas J. Brahan
*Attorney, Agent, or Firm*—Mason, Fenwick & Lawrence

[57] ABSTRACT

A personnel trolley and elevator platform for a cargo container handling gantry crane wherein the gantry is comprised of outreach boom and inboard girder portions having trolley rails mounted thereon, the personnel trolley being mounted on the rails between the cargo container handling trolley and the end of the boom and including its own traveling motors for independent movement along the boom with the lift and lower machinery for the elevator platofrm mounted thereon.

4 Claims, 5 Drawing Sheets

PERSONNEL TROLLEY AND ELEVATOR PLATFORM FOR A CARGO CONTAINER HANDLING GANTRY CRANE

BACKGROUND OF THE INVENTION

1. Field of the Invention

The present invention relates to trolleys for gantry cranes and more particularly to a personnel trolley and elevator platform for a cargo container handling gantry crane wherein the gantry is comprised of an outreach boom and inboard girder portions having trolley rails mounted thereon for supporting the cargo container handling trolley.

Large dockside gantry cranes which are used to load and unload standardized cargo containers onto and off of container ships have been employed for many years. Over this period of time they have greatly increased their efficiency of operation through various structural modifications and improvements in operating techniques. Recently, significant investment has been made worldwide by the high volume ports on innovations which are intended to increase the through-put of containers being handled in loading and off-loading container ships. The costs of new dockside container handling cranes have increased significantly due to improvements which increase the container through-put by only a few containers per hour of operation.

In addition to the structural improvements to container handling cranes, their methods of operation have been altered significantly to increase the effectiveness of their operation.

In 1983, OSHA promulgated a new set of regulations applicable to marine terminals (29 CFR Part 1917) which expressly permits longshoring crews to be transported on dockside container crane lifting spreader beams, which are utilized to engage the cargo containers, if certain measures are taken for the safety of the crews. While some crane manufacturers do not concur with OSHA that such movement of personnel is safe, it is a fact that many dockside container crane owners, which have optimized the operation of their container handling equipment, have added personnel platforms and cages to the container handling lifting spreaders, and that longshoring crews are now regularly transported on the spreaders in many container handling terminals.

The crews are transported on the spreaders for two reasons: first, to move the crews from shore to ship and from ship to shore at the beginning and end of the work shifts, and second, to transport longshoremen to the tops of container stacks for the removal or the implacement of container lashings and stacking cones which are employed in the stacking of containers. When it is necessary to move personnel for these purposes, the container crane must cease handling containers in order to move the crews. Concurrently, the lifting spreader acts as the stowage bin for stacking cones, as well as serving as the crew taxi, so the delay includes time for stowing or removing stacking cones in addition to the lost time for movement of the personnel.

Obviously, an improvement in container crane handling efficiency will result if an alternative means can be utilized to move the crews concurrently with container handling rather than consecutively. Equally as obvious is the fact that an independent means for doing so would be desirable but providing such a means on a gantry crane is complicated for many reasons.

2. Description of the Prior Art

A cargo container handling gantry crane of the type to which the present invention can be adapted is disclosed in U.S. Pat. No. 3,945,503 to Cooper, issued Mar. 23, 1976, for a CRANE WITH A VARIABLE CENTER ROPE SUSPENSION SYSTEM. Shown in FIG. 1 thereof is a crane superstructure which supports a gantry comprised of two parts; the inboard trolley-girders and the outboard retractable boom portion. Trolley rails are mounted on the gantry so that a cargo container handling trolley can be mounted on the gantry to move from one end to the other and carry a suspended container thereunder. The design of the crane is such that the load can be moved from one end of the gantry to the other without physically interfering with the crane superstructure. The crane is also mounted on tracks whereby it can be moved along the wharf dockside between ship docking locations. A lifting spreader is suspended under the trolley by a headblock attached to the spreader. The spreader engages the tops of cargo containers for lifting and moving them between dockside and a ship for loading or unloading.

Shown in FIGS. 7 and 8 of the '503 patent is the wire rope reeving arrangement for moving the trolley along the gantry rails and for lifting and lowering the lifting spreader which is suspended from the trolley. The particular hoist reeving arrangement there illustrated, which lifts and lowers the load, is known in the industry as fleet through reeving. Its dominant characteristic is that it allows the hoisting drums and associated hardware to be mounted in a machinery house on the crane superstructure rather than on the gantry or on the trolley. At the same time, the design of the reeving allows free movement of the trolley along the gantry without affecting the overall length of the lifting ropes or the attitude of the lifting spreader and its load when the trolley moves along the rails.

It will be seen that imposing yet another moveable trolley into the reeving of the prior art systems poses considerable problems: especially when the additional trolley would be expected to operate independently of all the lifting spreader wire rope reeving and trolley tow rope reeving and yet concurrently with it when that wire rope reeving is operating and moving cargo containers.

SUMMARY OF THE INVENTION

The present invention is a personnel trolley and elevator platform for a cargo container handling gantry crane having lifting spreader trolley rails mounted on the gantry thereof. It comprises an independent self-powered trolley mounted on the lifting spreader trolley rails disposed on the outboard end of the gantry between the lifting spreader trolley and the waterside end of the gantry. An elevator platform is reeved to the self-powered personnel trolley and suspended thereunder. The wire rope hoist drums for lifting and lowering the elevator platform are mounted thereon along with the lift and lower and horizontal movement controls for both the trolley and elevator. Fleet through sheaves and rollers are mounted on the independent personnel trolley to guide the crane fleet through reeving as it passes over, through, and/or under the personnel trolley when either it or the container handling trolley moves.

OBJECTS OF THE INVENTION

It is therefore an important object of the present invention to provide an independent personnel trolley and elevator for a cargo container handling gantry crane which can operate concurrently with and independently of the cargo container handling machinery of the crane.

It is another object of the present invention to provide a personnel trolley and elevator for a cargo container handling gantry crane which has its own redundant lift and lower machinery for the elevator.

It is a further object of the present invention to provide a personnel trolley and elevator for a cargo container handling gantry crane wherein the controls for the elevator and personnel trolley can be operated by the occupants thereof or by the crane operator.

And it is still another object of the present invention to provide a personnel trolley and elevator platform for a cargo container handling gantry crane which can be mounted on the gantry trolley rails and which can operate without interfering with the wire rope reeving for the container handling trolley.

Other objects and advantages of the present invention will become apparent when the personnel trolley and elevator platform of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
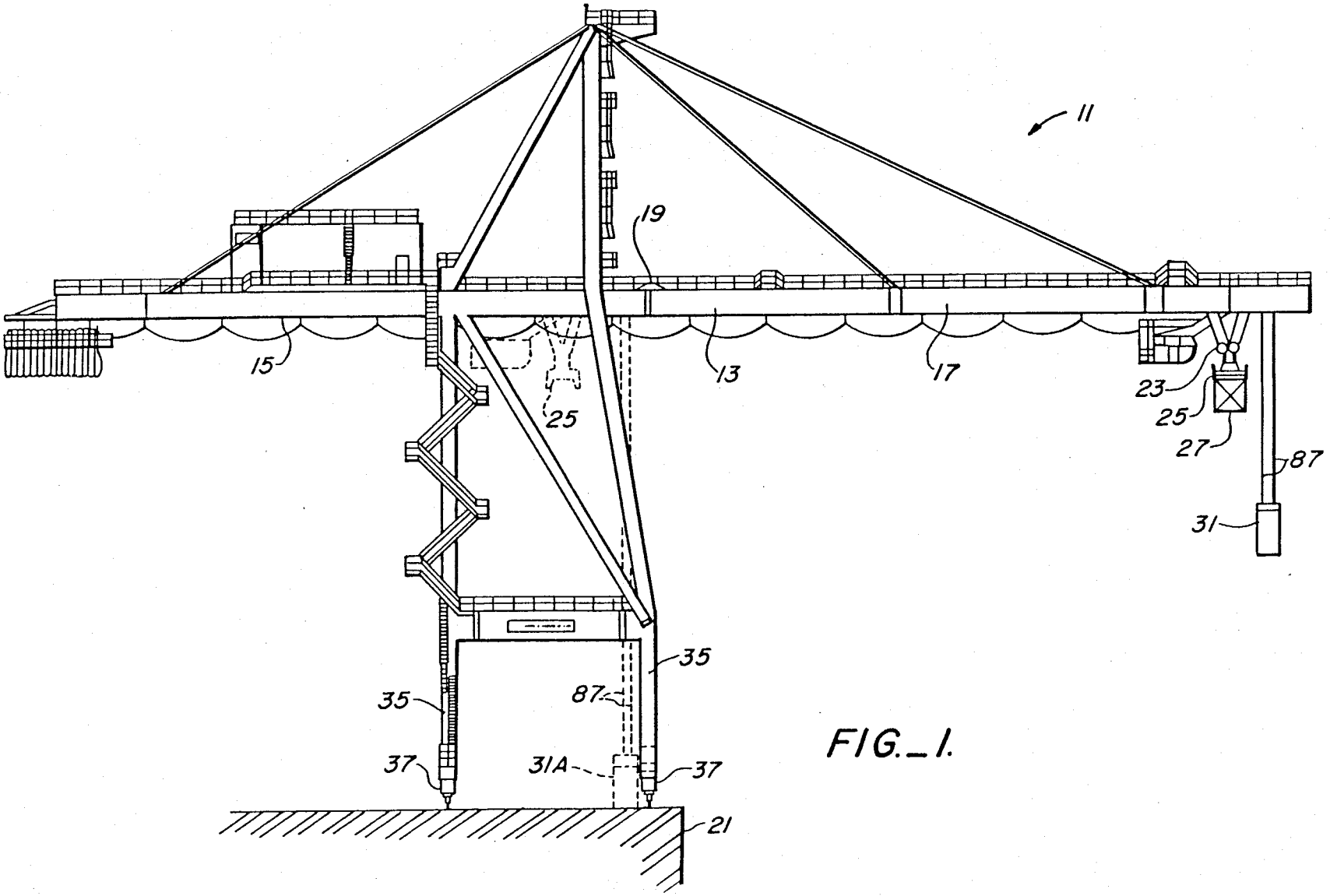
FIG. 1 is a side elevation of a typical gantry crane employing the present invention.
Figure 2:
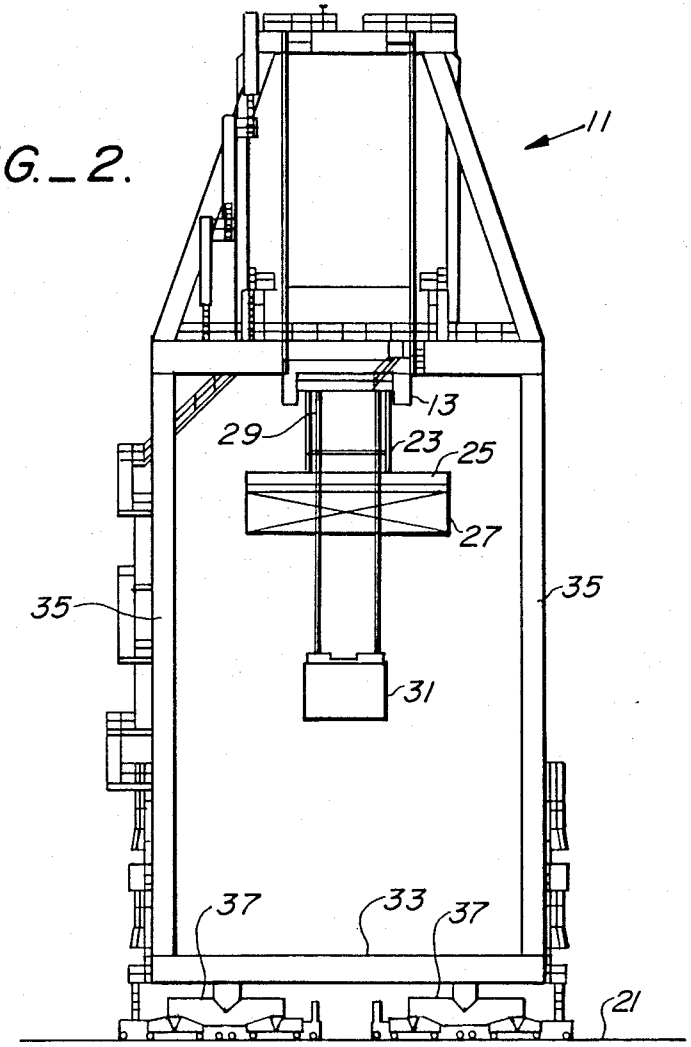
FIG. 2 is an end elevation of FIG. 1.

FIGS. 1 and 2 of the drawings illustrate a crane superstructure 11 supporting a horizontal gantry 13 that is comprised of a dockside or inboard trolley-girder portion 15 and a waterside or outboard retractable boom portion 17. The outward projecting boom 17 can be rotated about hinges 19 at its inboard end to an upward projecting retracted position so that the outboard end does not interfere with a ship's superstructure when a ship pulls alongside the dock 21. The crane structure shown is essentially the same as described in the prior art, but the personnel trolley and elevator of the present invention can be adapted to a wide variety of gantry type cranes.

The crane gantry is provided with lifting spreader trolley rails which extend along the length of both the girder and boom portions 15, 17. A container &handling trolley is mounted on the rails (between the girders) and supports a suspended lifting spreader headblock 23 which engages a lifting spreader 25 which in turn engages the individual cargo containers 27. Also mounted on the lifting spreader trolley rails is an independent self.powered personnel trolley 29 of the present invention which has an elevator platform 31 reeved thereto and suspended thereunder. The personnel trolley is mounted on the trolley rails at a position disposed between the cargo container lifting spreader trolley and the outboard end of the boom.

When the gantry boom 17 is retracted, the personnel trolley 29A is stowed on the waterside end of the trolley-girders (shown in dashed lines), just to the land side of the boom hinges 19, usually with the elevator 31A lowered and ready for occupancy. Independent lockable controls for lifting and lowering the elevator platform can be located on one of the legs of the crane structure so that the elevator can be raised to engage with its trolley for stowage during windy conditions and to prevent unauthorized persons from entering the elevator.

The stowed position of the personnel platform can be at dock level or on top of the waterside sill beam 33 which extends between the waterside legs 35 of th<-crane supporting structure. This alternative position would keep the personnel platform out of the way of dock traffic. When stowed, the elevator platform will be secured to either the sill beam or to the truck assemblies 37 under the waterside legs.

Figure 5:
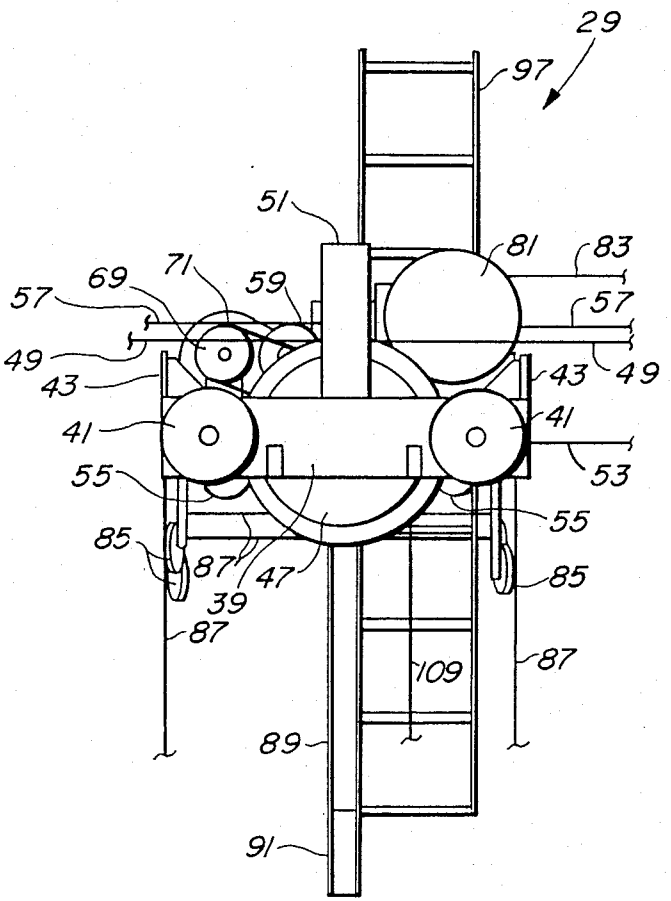
FIG. 5 is an end elevation of FIG. 3.
Figure 4:
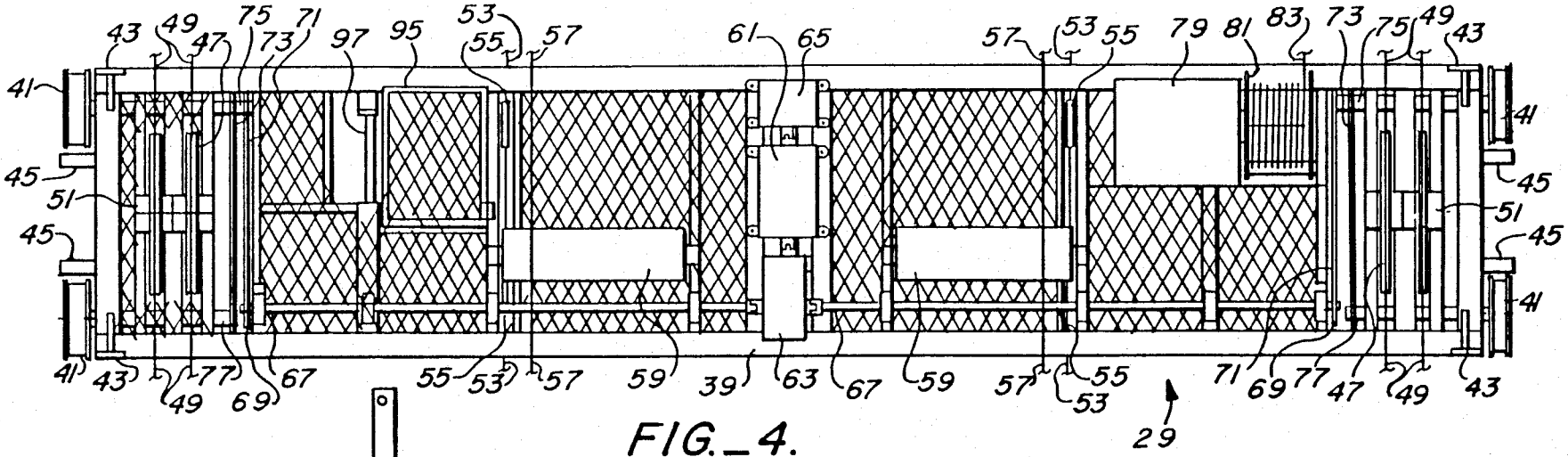
FIG. 4 is a top plan view of FIG. 3.
Figure 3:
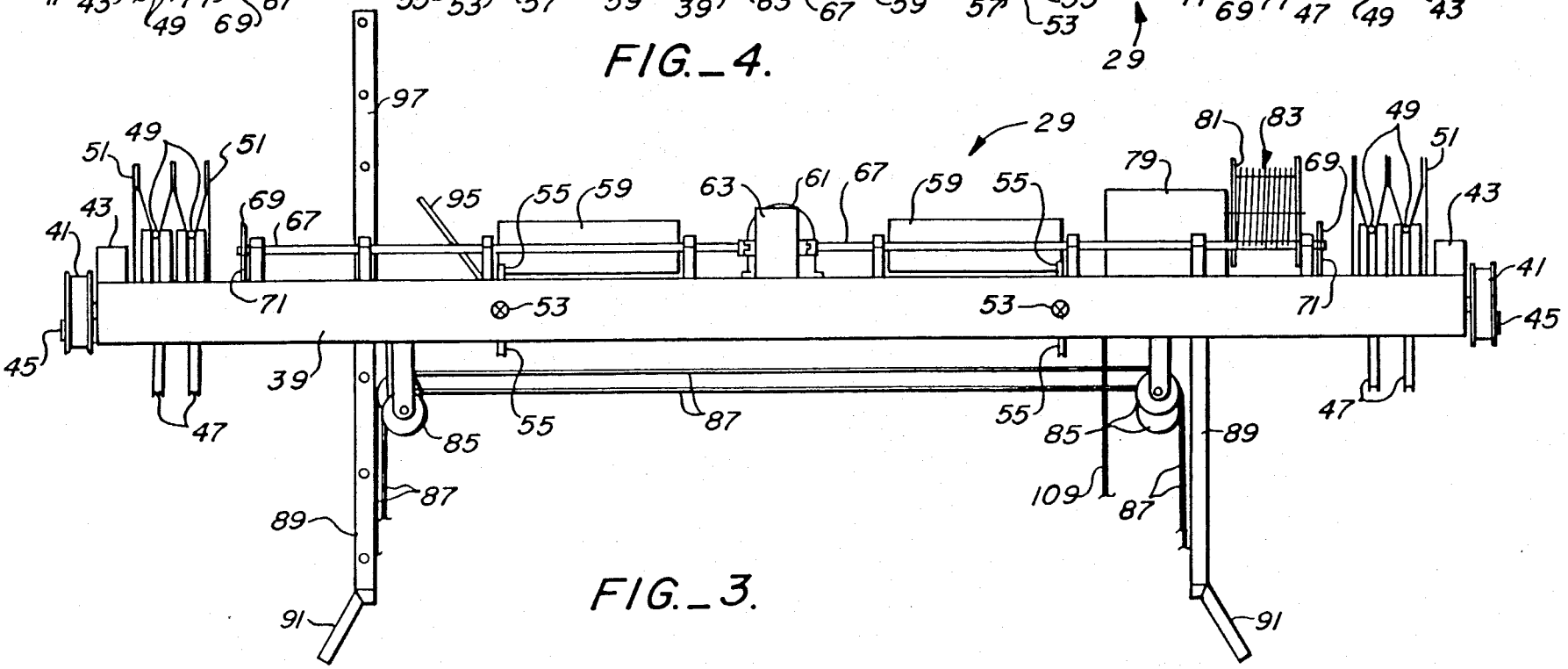
FIG. 3 is a side elevation of the personnel trolley of the present invention.

Reference is made to FIGS. 3–5 which illustrate the personnel trolley 29. The personnel trolley frame 39 is provided with wheels 41 at its four corners which are flanged to engage the lifting spreader trolley nails. The trolley frame is also provided with bumpers 43 at the corners thereof which act as shock-absorbers. Drop blocks 45 are also provided which prevent the trolley from falling between the rails in the event one or more of the wheel axles breaks.

The trolley frame 39 is also provided with guide sheaves 47 which support and guide the container handling trolley hoist ropes 49 as they pass over the personnel trolley when it moves along the gantry 13. The hoist rope guide sheaves are also provided with riser guides 51. During container handling operations, these wire ropes often bounce up and down, and the riser guides ensure that the ropes return to rest in the sheaves. In those applications where the height of these guides must be reduced to provide clearance inside the operating envelope for the personnel trolley, low profile support rollers could be utilized instead of riser guides and sheaves.

The personnel trolley 29 is disposed on the crane gantry 13 to the outboard or waterside of the cargo container handling trolley. The main hoist ropes 49 for the lifting spreader trolley which pass over the personnel trolley do not move longitudinally along the gantry outboard of the container handling trolley, but the personnel trolley does move with respect to the main hoist ropes, and so the support sheaves 47 on the personnel trolley are free to rotate when it moves along the gantry. The weight of the main hoist ropes resting on the support sheaves operates to hold the personnel trolley on the trolley rails.

The personnel trolley 29 also provides means for guiding the cargo container lifting spreader trolley tow ropes. In the preferred embodiment, the lower tow ropes 53 which are reeved from the end of the crane boom to the container handling trolley pass through the personnel trolley. The tow ropes move with respect to the personnel trolley when either it or the container handling trolley is moving. Pairs of guide sheaves 55 disposed along the inboard and outboard edges of the personnel trolley control the passage of the two tow ropes through the trolley. The upper tow ropes 57 which emanate from the machinery house, and are reeved to and around the fixed sheaves at the end of the boom, pass above the personnel trolley surface and are supported in passage by a pair of support rollers 59. Depending upon the position of the personnel trolley on the boom, the two overpassing ropes 57 may be relatively close together or as far apart as the two return tow ropes 53, and for this reason support rollers 59 must be utilized to provide lateral width to the support surface for the upper tow ropes 57.

The personnel trolley 29 is provided with a rotor 61 and gearbox system 63 which drives all of the four trolley wheels 41. A sprocket and chain drive is utilized for positive control and accurate positioning. This system powers the personnel trolley so that it can ba moved independently of the cargo container handling trolley. The horizontal movement of the personnel trolley can be controlled by the occupants of the elevator platform which is suspended under the personnel trolley by its own independent reeving.

The trolley drive system includes a drive brake 65 which is engaged with the drive motor 61, and the gear box 63 which powers a pair of drive shafts 67 that extend laterally from the gearbox. The ends of the drive shafts are provided with sprockets 69 which drive chains 71 that engage the shafts of the drive wheels 41. In the preferred embodiment, the drive shaft sprocket 69 drives one of the drive wheels and an interconnecting chain drive 73 from the first drive wheel shaft 75 drives the second drive wheel shaft 77 at the same end of the trolley.

An electrical panel box 79 is mounted on the personnel trolley for providing power to the personnel trolley and utilizes a power cable takeup reel 81 which obtains its power through a cable 83 from the outboard end of the gantry boom. Alternatively the crane festoon rail could be extended all the way to the end of the boom and the personnel trolley could have its own festoon system extending from the outboard end of the boom back to the trolley. Alternatively, the power cable takeup reel could lay down a power line between the trolley rail and the boom face nearest the rail.

The personnel elevator hoist sheaves 85, which are located under the personnel trolley frame 39 for suspending the personnel platform from the elevator hoist ropes 87, are positioned so that the hoist ropes cross each other at the center of the trolley. In order to avoid contact between the ropes, one pair of sheaves is positioned lower than the other. Independent dual personnel platform hoist ropes are utilized for redundancy, and reeving the ropes on this manner allows the platform to be supported from diagonal corners. If one of the hoist ropes separates, no dangerous tilting of the platform will result.

Figure 7:
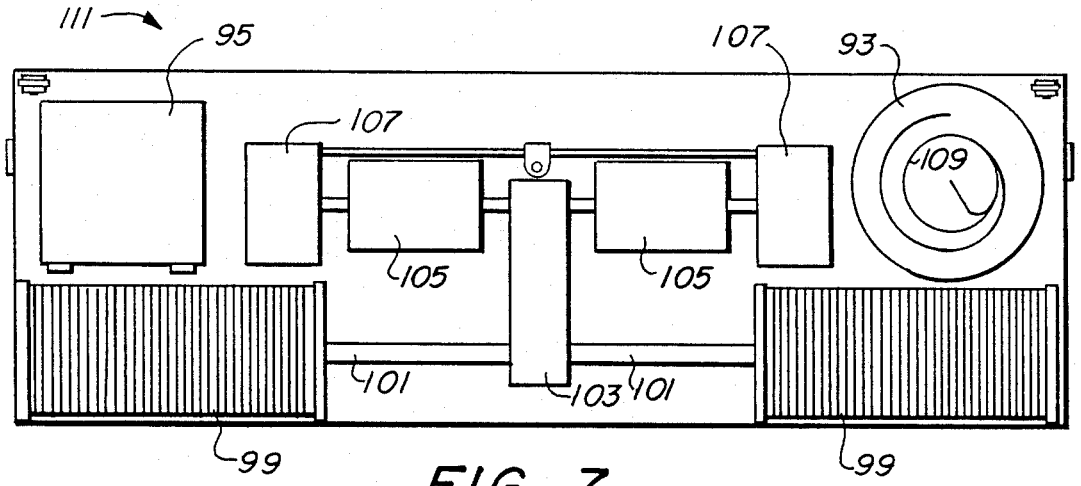
FIG. 7 is a top plan view of FIG. 6.
Figure 6:
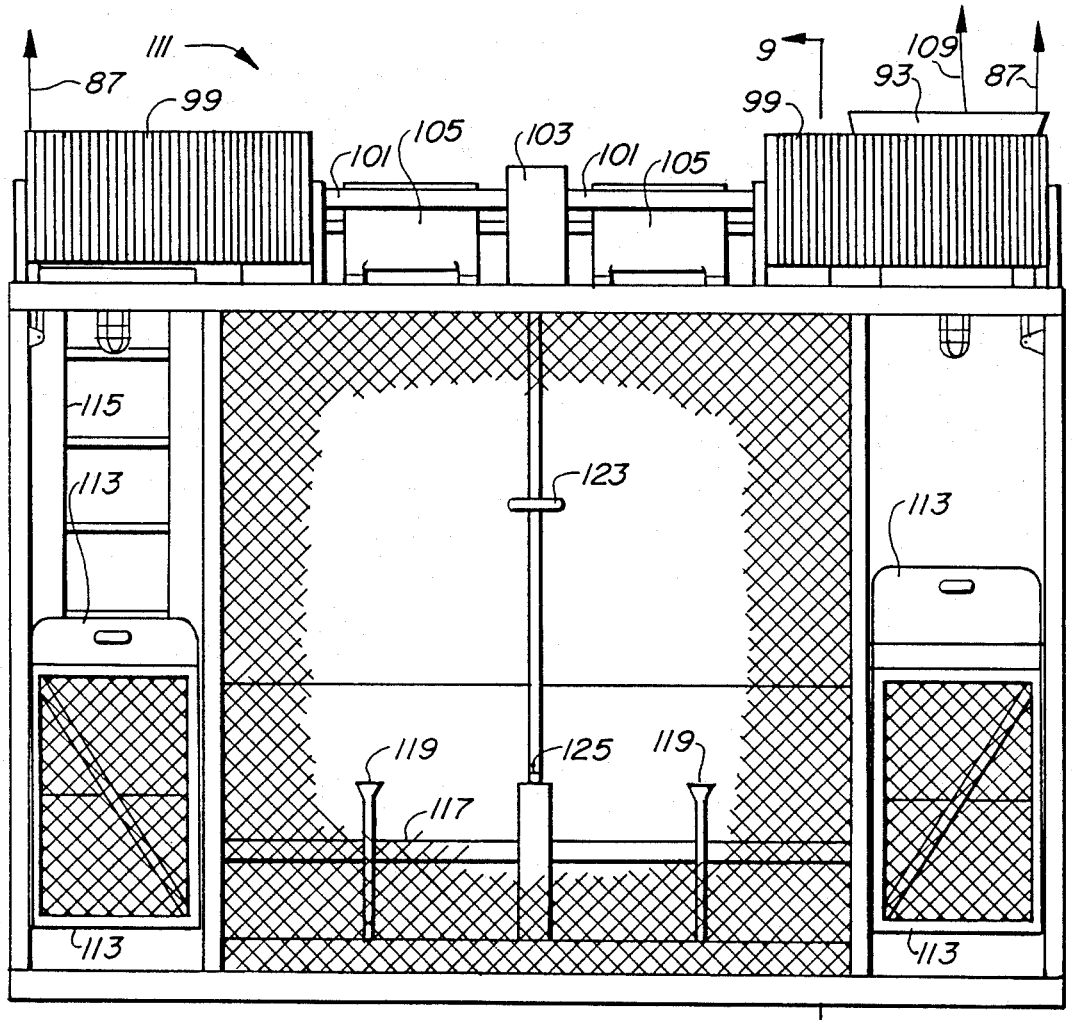
FIG. 6 is a side elevation of the personnel elevator of the present invention with a portion broken out in the center of the wire screen.
Figure 10:
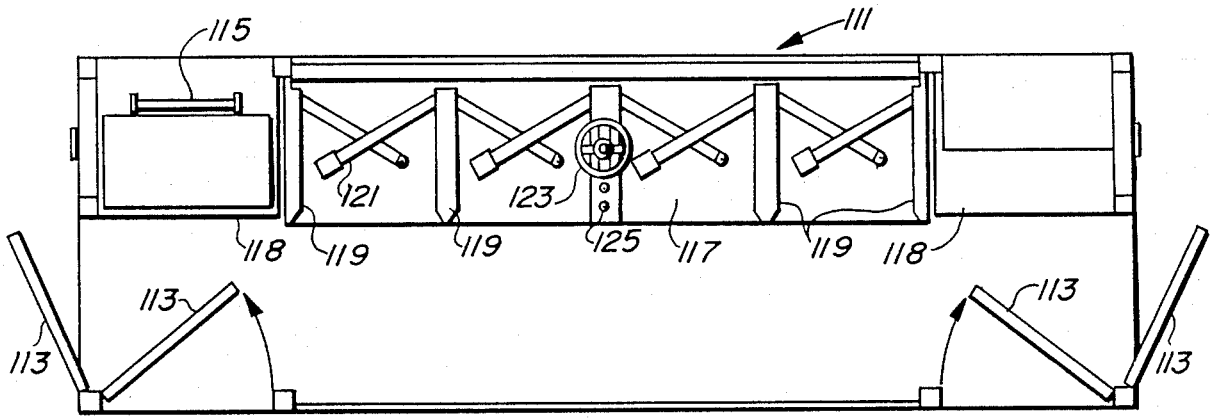
FIG. 10 is a partial section taken along line 10—10 of FIG. 8.
Figure 8:
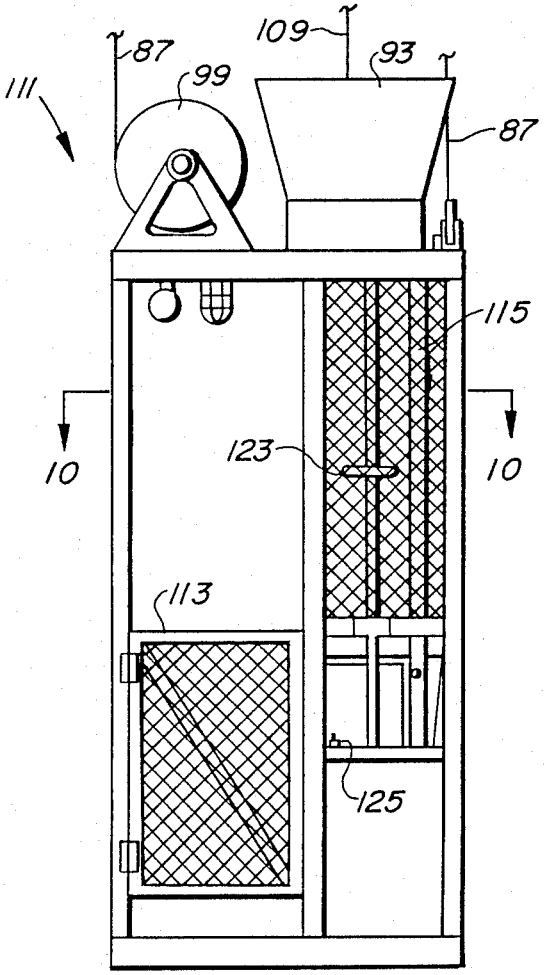
FIG. 8 is an end elevation of FIG. 6.
Figure 9:
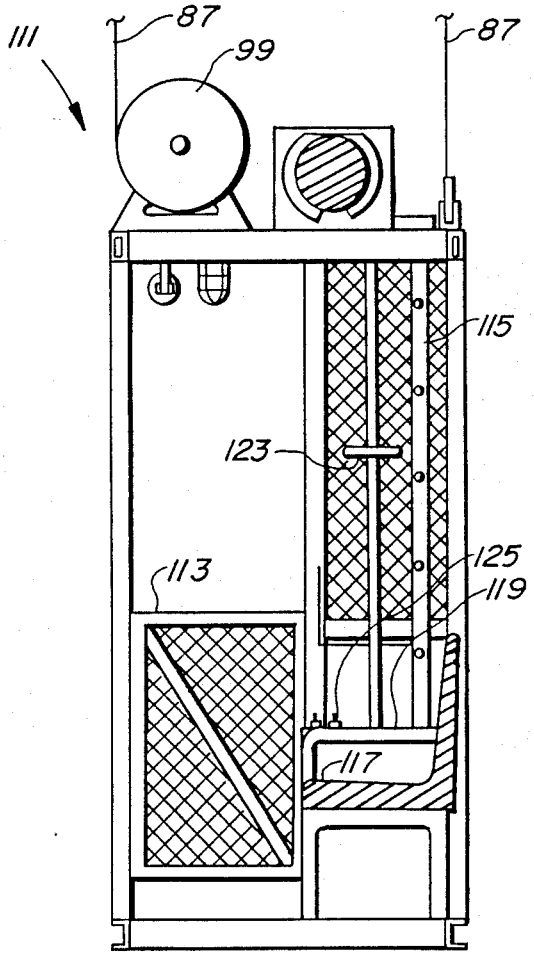
FIG. 9 is a partial section taken along line 9—9 of FIG. 6.

A pair of elevator guides/stops 89, 91 extend below the bottom of the personnel trolley 29. The flared guides 91 center the elevator platform 31 as it is raised tc engage the stops. The length of the stops 89 is selected assure that the machinery and electrical cable tub 93 on the top of the elevator (FIGS. 6–8) are not raised so high as to contact the platform hoist rope sheaves 85. In addition, if the elevator platform is raised until it is in firm contact with the guides/stops, platform motion will be restrained during transition of the crew members between the elevator platform and the personnel trolley or while the personnel trolley is in transit.

Both the personnel trolley 29 and the elevator platform 31 are provided with hatches 95 and the personnel trolley is provided with a ladder 97 which extends down to the top of the personnel platform when it is disposed against the guide stops. Additional guide stops could be positioned alongside the inboard and outboard sides of the personnel trolley to center it longitudinally beneath the platform trolley as well as laterally.

Reference is made to FIGS. 6–10 which illustrate the personnel elevator platform of the present invention. The top of the elevator (FIG. 7) provides a machine bench for the elevator hoist apparatus. A pair of wire rope drums 99 mounted thereon are driven by drive shafts 101 which extend from a hoist drive gear box 103. The gear box in turn is driven by a pair of hoist motors 105 for redundancy. These hoist motors are also engaged with independent but interconnected brakes 107, also for redundancy.

An electrical cable tub 93 is mounted on top of the machinery bench for containing the electrical cable 109 which obtains power from the personnel trolley to operate the hoist motors. A hatch 95 is provided in the machinery bench to permit personnel to gain access to the top of the bench to work on the machinery and also to permit them to move from the elevator to the personnel trolley when it is disposed up against its guide stops proximate the personnel trolley.

The elevator platform is provided with a personnel cage 111. It has several gates 113, both to the sides and to the front and rear of the cage, and a ladder 115 to the top hatch. Access and egress is possible in five directions and each direction has a protective gate or hatch cover. The cage is provided with seats 117 for personnel and space 118 for stowage of stacking cones. It is preferably provided with wire mesh instead of solid walls to reduce wind resistance and lessen sway. Since the platform may sway significantly in strong winds, arm rests 119 and seat belts 121 are provided and the mesh screen on the rear of the seating compartment acts as a head restraint.

The hoist machinery for the personnel elevator is located on top of the elevator platform for specific reasons. It adds weight and stability to the platform and makes it less susceptible to being moved by wind gusts. Equally as important is the fact that an emergency brake release wheel 123, which controls the wire hoist rope machinery, is located inside the platform enclosure &o allow the occupants to manually release the elevator hoist brakes and safely lower the platform in the event of a power outage. Redundant hoist ropes, drums, motors and brakes are used for personnel safety so that the failure of a single rope, motor, or brake does not result in the elevator dropping and injuring the crew.

The primary elevator hoist and personnel trolley horizontal movement controls 125 are located inside the elevator platform cage. Another set of operative controls are located in the crane operator's cab as well as at the base of one of the crane legs. A control interlock is provided so that an inattentive operator cannot cause the container handling trolley to collide with the personnel trolley or cause the lifting spreader to swing and collide with the personnel elevator.

Estimates have been made that suggest that as much as 10% of the capability of a cargo container handling crane is lost due to the need to move personnel among the tops of boxes and the time required for stowing or removing stacking cones. This diminution of container handling capability can be eliminated by means of the present invention because it provides an independent means of access to the tops of containers stacked on deck and provides an independent means for stowing the stacking cones which have been removed from a container stack. In addition to the increased work crew safety and through-put capability of the container crane, which are the main features and advantages achieved by the present invention, there are other features which are also important. The fact that the personnel trolley will run on the same rails as the container handling trolley and can be intermeshed with the intricate wire rope reeving used to operate the cargo container lifting spreader means that the present invention can be retrofitted to present container handling gantry cranes and likewise increase their capability.

The problem of eliminating the need to utilize the cargo container lifting spreader to transport personnel has plagued the crane operators for years, and no solution has been satisfactory prior to the development of the present invention. It provides personnel transport by means of an independent elevator and trolley which can be retrofitted and integrated into present day gantry cranes.

It will therefore be apparent from the foregoing description of the invention, in its preferred form, that it will fulfill all the objects attributable thereto, and while it is illustrated and described in considerable detail, the invention is not to be limited to such details as have been set forth except as may be necessitated by the appended claims.

I claim:

1. In a personnel trolley and elevator platform for a cargo container handling gantry crane having a lifting spreader trolley mounted for movement on lifting spreader trolley rails mounted on the gantry thereof, controlled from an elevated cab, said gantry including a boom having an outboard end, the invention comprising an independent self-powered personnel trolley mounted on said rails and having a personnel elevator platform reeved thereto and suspended thereunder, said personnel trolley being disposed or position on the gantry between said lifting spreader trolley and the outboard end of said boom and, wire rope drums for lifting and lowering said elevator platform, lift and lower and horizontal movement controls for said personnel trolley and elevator located in said elevator platform, and means for guiding the wire rope reeving of the crane relative to the personnel trolley when the reeving or the personnel trolley more relative to each other.

2. The personnel trolley and elevator platform of claim 1 wherein said wire rope drums for lifting and lowering said elevator platform are mounted on the elevator platform and include independent redundant systems.

3. The personnel trolley and elevator platform of claim 2 wherein the independent redundant systems are reeved to opposite corners of the personnel elevator platform.

4. In a personnel trolley and elevator platform for a cargo container handling gantry crane having a lifting spreader trolley mounted for movement on lifting spreader trolley rails mounted on the gantry thereof having a waterside end and a dockside end and controlled from an elevated cab the invention comprising an independent self-powered personnel trolley mounted on said rails and disposed or positioned on the gantry between the lifting spreader trolley and the waterside end of the gantry for independent movement relative to said lifting spreader trolley, said personnel trolley having a personnel elevator including an elevator platform reeved thereto and suspended thereunder, redundant wire rope hoist drums mounted on said elevator platform for lifting and lowering said personnel elevator, the wire ropes from said drums being independent and reeved to opposite corners of the personnel elevator, lift and lower and horizontal movement controls and hoist reeving brake release controls for said trolley and elevator located in said elevator platform, and means for guiding the wire rope reeving of the crane relative to the personnel trolley when either the reeving or the personnel trolley moves.

* * * * *